US006139140A

United States Patent [19]

Rasmussen et al.

[11] Patent Number: 6,139,140

[45] Date of Patent: Oct. 31, 2000

[54] INKJET PRINTING APPARATUS WITH MEDIA HANDLING SYSTEM PROVIDING SMALL BOTTOM MARGIN CAPABILITY

[75] Inventors: Steve O Rasmussen; Richard A Kelley, both of Vancouver; Brooke E Smith, Brush Prairie; Geoff Wotton, Battleground, all of Wash.

[73] Assignee: Hewlett-Packard Company, Palo Alto, Calif.

[21] Appl. No.: 09/163,274

[22] Filed: Sep. 29, 1998

[51] Int. Cl.[7] ..... B41J 2/01; B41J 13/10

[52] U.S. Cl. ..... 347/104; 400/635; 400/642

[58] Field of Search ..... 347/104; 400/634, 400/635, 642, 645, 56

[56] References Cited

U.S. PATENT DOCUMENTS

| | | | |
|---|---|---|---|
| 4,207,579 | 6/1980 | Gamblin et al. . | |
| 4,447,817 | 5/1984 | Naramore . | |
| 4,660,752 | 4/1987 | Rikard et al. . | |
| 4,682,904 | 7/1987 | Yoshimura et al. . | |
| 4,821,049 | 4/1989 | Eckl . | |
| 4,843,338 | 6/1989 | Rasmussen et al. . | |
| 5,276,970 | 1/1994 | Wilcox et al. . | |
| 5,342,133 | 8/1994 | Canfield . | |
| 5,345,863 | 9/1994 | Kurata et al. . | |
| 5,393,151 | 2/1995 | Martin et al. . | |
| 5,419,644 | 5/1995 | Martin et al. . | |
| 5,531,436 | 7/1996 | Ohyama et al. | 347/104 |
| 5,593,240 | 1/1997 | Broder et al. . | |
| 5,646,668 | 7/1997 | Fujioka et al. | 347/104 |
| 5,913,627 | 6/1999 | Freeman et al. | 400/642 |
| 5,943,081 | 8/1999 | Uchida et al. | 347/104 |

FOREIGN PATENT DOCUMENTS

| | | |
|---|---|---|
| 5112001 | 5/1993 | European Pat. Off. . |
| 0640479 | 3/1995 | European Pat. Off. . |
| 7304167 | 11/1995 | European Pat. Off. . |
| 60-48385 | 3/1985 | Japan . |

*Primary Examiner*—Eugene Eickholt

[57] ABSTRACT

Accurate advance of a media sheet is achieved by carrying the media sheet on a belt loop support. An upstream pinch roller holds the media sheet to the belt upstream of the print zone. A downstream pinch roller holds the media sheet to the belt downstream of the print zone. A guide shim extends along the media path from a position upstream of the upstream pinch roller, passed the upstream pinch roller under a printhead adjacent to the print zone. The location of a lead edge of the guide shim relative to the print zone determines the minimum bottom margin for the inkjet printing device. The guide shim presses the media sheet to the belt support and keeps the media sheet flat under the inkjet printhead as the printhead moves over the media sheet.

19 Claims, 2 Drawing Sheets

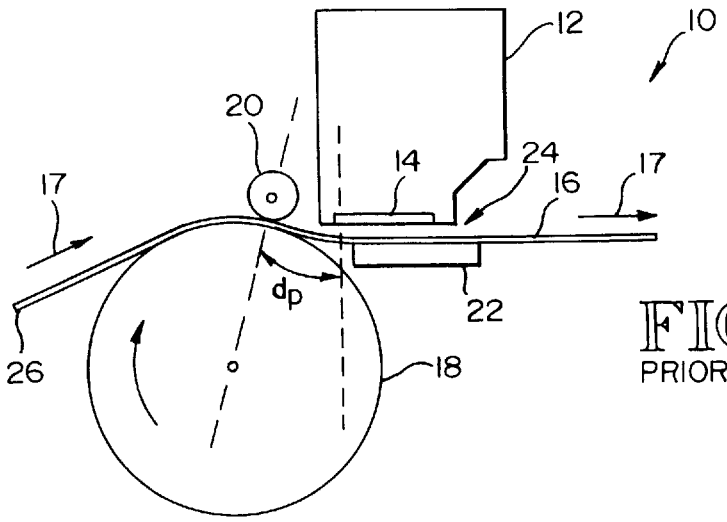
FIG. 1
PRIOR ART
FIG. 2
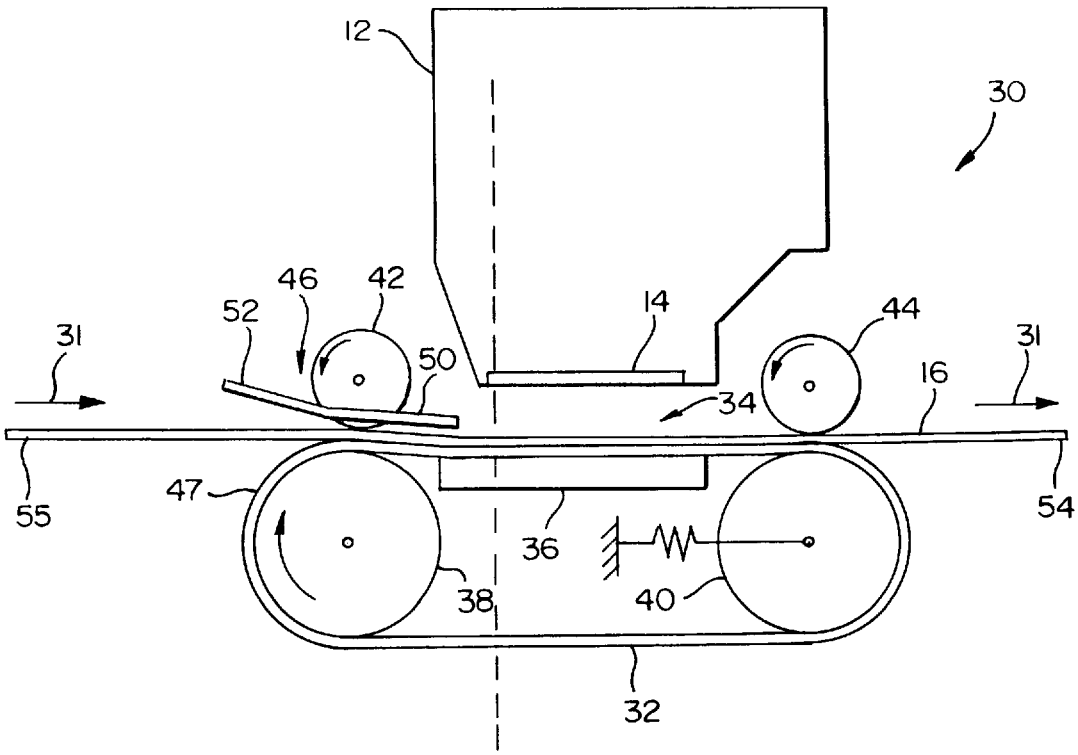

INKJET PRINTING APPARATUS WITH MEDIA HANDLING SYSTEM PROVIDING SMALL BOTTOM MARGIN CAPABILITY

BACKGROUND OF THE INVENTION

This invention relates generally to media handling systems for inkjet printing devices, and more particularly to a media handling system which is capable of achieving small bottom margins.

Known inkjet printing devices which use single sheet or cut sheet media have a limited bottom margin capability. One of the smallest bottom margins achievable is approximately 11.7 mm by the Hewlett Packard 800 series DeskJet™ printers. Many applications could take advantage of a smaller bottom margin, if available on single sheet and cut sheet inkjet printers. Continuous form inkjet products are able to achieve smaller bottom margins because a current page is attached to a subsequent page during printing. The pages are detached after printing.

Other inkjet printing concerns which impact the bottom margin limitation are the need for accurate dot placement and the need to account for the effects of wet ink printing. Both of these concerns impact a larger portion of the media sheet than simply the immediate area being printed at any given time. Media handling is one function controlled to achieve accurate printing and wet ink control. In the series 800 DeskJet™ printers, for example, pinch rollers keep the media sheet in contact with a drive roller as the media sheet is fed through a print zone adjacent to a printhead. The pinch rollers prevent media slippage and allow for accurate dot placement. Cockle control devices such as ribbed devices place a known bend pattern in the paper downstream from the print zone which prevents cockle from occurring in the print zone. The pinch rollers isolate the cockled area from a flat media sheet area in the print zone.

The relative location of the pinch rollers relative to the print zone determines how small the bottom margin can be. Typically, the print zone is located close to the pinch roller's line of contact with the media sheet, but further along the media sheet path than the pinch roller's line of contact. Once the media sheet's trailing edge passes beyond the pinch roller, there typically is nothing holding the media sheet in place. Accordingly, printing on the media sheet after contact is lost with the pinch roller is subject to inaccuracies. The manufacturer avoids these inaccuracies by making the minimum bottom margin large enough that the media sheet is still in contact with the pinch roller. Typically the distance from the nearest edge of the print zone to the pinch roller line of contact equals the minimum bottom page margin achievable for an inkjet print apparatus.

One way of reducing the minimum bottom margin is to place the pinch roller closer to the print zone. There is a limit, however, to how close the pinch roller line of media sheet contact can be to the print zone. Another scheme is to make the pinch roller diameter smaller, so that the distance between the print zone and pinch roller can be shorter. However, media advance accuracy suffers as the pinch roller becomes too small.

The pinch roller also serves to provide a reverse bowing which reduces cockle growth from the wet ink printing. Cockle growth refers to the buckling or ridges in a media sheet due to the presence of wet ink soaking into the media sheet. As the pinch roller becomes too small the reverse bow desired for limiting cockle growth becomes difficult to maintain. Accordingly, there is a need for a method and apparatus for allows for smaller bottom margins than the distance between pinch roller and print zone.

SUMMARY OF THE INVENTION

According to the invention, a media handling system provides accurate positioning of a media sheet through a print zone to allow for smaller bottom margins than known minimum bottom margins for single sheet or cut sheet inkjet printing devices. Minimum bottom margins less than 5 mm, and as low as 1 mm or 2 mm are achieved. This is a substantial improvement over the 11.7 mm minimum bottom margin achieved by current inkjet printing devices.

The media sheet is positioned on a moving support while traveling through the print zone. A pinch roller presses the media sheet to a drive roller or the support upstream from the print zone. The moving support and pinch roller stabilize the media sheet while the media sheet moves through the print zone.

According to one aspect of the invention, a guide shim is operatively positioned with the upstream pinch roller. The guide shim extends along the media path beyond the upstream pinch roller toward the print zone. The guide shim abuts or comes close to the print zone. The location of a lead edge of the guide shim relative to the print zone determines the minimum bottom margin for the inkjet printing device. One function of the guide shim is to provide media advance accuracy as the media sheet trailing edge departs contact with the upstream pinch roller and continues on to the print zone. Another function is to maintain the media flatness as the media sheet continues to the print zone. The guide shim serves to keep the media sheet under the inkjet printhead as the printhead moves over the media sheet. Cockle growth is limited by maintaining such flatness.

According to another aspect of the invention, in some embodiments there is another pinch roller located downstream of the print zone. The support and pinch rollers stabilize the media sheet while the media sheet moves through the print zone. The downstream pinch roller is of a star wheel configuration to minimize contact with the media sheet and avoid smudging the wet ink on the media sheet. A function of the downstream pinch roller is to hold the media sheet down and away from the inkjet printhead. Another function is to assist in advancing the media, especially once the media sheet trailing edge has passed beyond the upstream pinch roller.

According to another aspect of the invention, the support is an endless belt loop which is driven by one or more drive rollers. Preferably the belt has a ribbing or a grit coating. The media sheet rests on the belt and is stationary relative to the belt while moving through the print zone. The belt provides a continuous surface moving uniformly from the upstream pinch roller through the print zone. The ribbing serves to reduce cockle growth due to the wet ink received on the media sheet. A grit coating, however, maintains more accurate referencing between the media sheet and the belt.

One advantage of the support, pinch roller, guide shim configuration is that media advance accuracy is maintained, and cockle growth is controlled, even while the media sheet trail edge leaves contact with the upstream pinch roller. A beneficial effect is that the minimum bottom margin is reduced. An advantage of the shim is that media advance accuracy is maintained even for pinch rollers which do not spin at identical speeds (e.g., due to manufacturing tolerances). These and other aspects and advantages of the invention will be better understood by reference to the following detailed description taken in conjunction with the accompanying drawings.

BRIEF DESCRIPTION OF THE DRAWINGS

FIG. 1 is a diagram of a portion of a conventional media handling system for illustrating minimum bottom margin;

FIG. 2 is a diagram of a portion of an inkjet printing apparatus according to an embodiment of this invention;

DESCRIPTION OF SPECIFIC EMBODIMENTS

Figure 3:
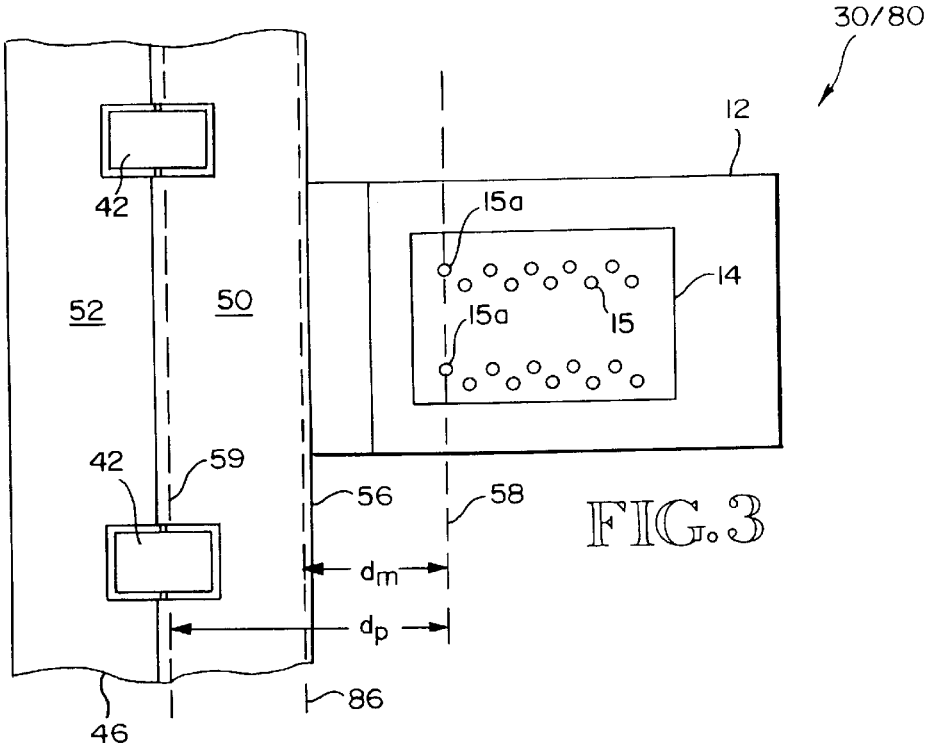
FIG. 3 is a diagram of the inkjet pen and guide shim of FIG. 2 (and FIG. 5), illustrating the minimum bottom margin for the inkjet printing apparatus of FIG. 2 (and FIG. 5)

FIG. 1 shows a conventional inkjet printing apparatus 10 including an inkjet pen 12 having a printhead 14. The printhead 14 includes a plurality of inkjet nozzles which eject ink onto a media sheet 16 during printing. The media sheet is moved along a media path in a direction 17 by one or more rollers, including a drive roller 18. A pinch roller 20 presses the media sheet to the drive roller 18. A platen 22 supports the media sheet 16 as the media sheet 16 is moved through a print zone 24. The print zone 24 is located adjacent to the printhead nozzles 15 (see FIG. 3) between the printhead 14 and the platen 22. Once a trailing edge 26 of the media sheet 16 passes beyond the pinch roller 20, there is nothing securing the media sheet, as the trailing edge 26 advances through the print zone 24. As a result, the minimum bottom page margin for the media sheet 16 is limited by this distance $d_p$ from the pinch roller 20 line of contact to the nozzle area of the printhead 14.

FIG. 2 shows an inkjet printing apparatus 30 which allows for a smaller bottom margin than the distance from pinch roller to inkjet nozzles. The inkjet printing apparatus 30 includes an inkjet pen 12 having a printhead 14. The printhead 14 includes a plurality of inkjet nozzles 15 (see FIG. 3) which eject ink onto a media sheet 16 during printing. The media sheet 16 is moved along a media path in a direction 31 by one or more rollers. Over a portion of the media path, the media sheet 16 is carried by a support 32. In a preferred embodiment the support is an endless belt loop. A print zone 34 occurs between the printhead 14 and the belt 32 in a region adjacent to the nozzles 15. The print zone 34 is the area where ink is ejected onto the media sheet 16. Within the print zone 34, a platen 36 maintains the belt 32 in a fixed orientation (e.g., so as to maintain a desired pen to media sheet spacing). As a result, the media sheet 16 is positioned at a known flat orientation within the print zone and ink is accurately applied to the media sheet 16.

The belt 32 runs along a drive roller 38 and an idler roller 40. The drive roller 38 is rotated by a drive motor causing the belt 32 to move along the rollers 38, 40. The idler roller 40 preferably is spring-loaded to maintain the belt at a desired tension. Preferably, the belt 32 is stiff enough to prevent stretching over time. However, the spring-loading of idler roller 40 serves to maintain a desired belt tension even in the presence of some stretching. The belt 32 is reinforced with Kevlar in some embodiments to resist stretching.

The printing apparatus 30 also includes an upstream pinch roller 42 and a guide shim 46. In some embodiments a downstream pinch roller 44 also is included, as illustrated. The upstream pinch roller 42 presses the media sheet 16 to an outer surface 47 of the belt 32 in an area between the upstream pinch roller 42 and the drive roller 38. The optional downstream pinch roller 44 presses the media sheet 16 to an outer surface 47 of the belt 32 in an area between the downstream pinch roller 44 and the idler roller 40. The guide shim 46 includes a first portion 50 which extends from approximately the pinch roller 42 toward the print zone 34. Preferably, the first portion 50 extends under the printhead 14 adjacent to the print zone 34. The first portion 50 keeps the media sheet 16 in contact with the belt 32. Another portion 52 of the guide shim 46 extends from a position upstream from the upstream roller 42 toward the roller 42. The portion 50 has a first orientation relative to the media path. The portion 52 has a second orientation relative to the media path which differs from the first orientation. The guide shim portion 52 is angled to direct an oncoming media sheet between the upstream pinch roller 42 and the drive roller and onto the belt 38. The guide shim portion 50 deflects the belt 32 and media sheet 16 to introduce a known bow to the media sheet.

In operation the drive roller 38 is rotated causing the belt 32 to rotate. A lead edge 54 of the media sheet 16 is guided by the shim 46 and the upstream pinch roller 42 onto the belt 32. The belt 32 carries the media sheet 16 as the drive roller 38 moves the belt 32 and the upstream pinch roller 42 presses a passing portion of the media sheet toward the belt 32 and drive roller 38. The belt 32 passes along the platen 36 carrying a portion of the media sheet 16 into the print zone 34. The printhead nozzles 15 eject ink onto the portion of the media sheet 16 within the print zone 34. The printed portion of the media sheet 16 is carried onward from the print zone 34 along belt 32 to the downstream pinch roller 44. The downstream pinch roller 44 presses the media sheet toward the idler roller 40. Preferably the downstream pinch roller 44 has a star wheel configuration which minimizes contact between the pinch roller 44 and the media sheet 16. This is desirable to avoid smudging the ink recently applied to the media sheet 16.

Typically, a media sheet 16 is longer than the distance from the upstream pinch roller 42 to the downstream pinch roller 44 along the media path. As a result, at least one of the upstream pinch roller 42 and downstream pinch roller 44 is in contact with the media sheet 16 while ink is being ejected onto any portion of the media sheet 16. The pinch rollers 42, 44 introduce a measure of stability to the media sheet during printing. In one embodiment the belt 32 is ribbed. The ribbing adds another measure of stability to the media sheet so that the downstream pinch roller 44 may be excluded in some embodiments.

The ribbing also helps reduce loss of printhead to media sheet spacing due to cockling of the media sheet 16. The guide shim 46 holds a portion of the media sheet flat and introduces a reverse bowing to the media sheet. This also helps to reduce cockling of the media sheet. The guide shim also serves to keep the media sheet under the inkjet printhead as the printhead 14 moves over the media sheet 16. This is desirable to prevent cockling of the media sheet where the media sheet bends upward into contact with the inkjet nozzles. Such contact can clog the inkjet nozzles 15, cause inaccurate dot placement and damage the printhead 14.

The guide shim 46 also aids in media advance accuracy as the media sheet trailing edge 55 departs contact with the upstream pinch roller 42 and continues on to the print zone 34. Specifically portion 50 of the guide shim 46 extends from the upstream pinch roller 42 toward and adjacent to the print zone 34. The shim together with the belt 32 and the star wheel contact of the downstream pinch roller 44, when included, stabilizes the media sheet 16 as the trailing edge 55 moves toward the print zone 34.

An advantage of the stabilizing action of the shim 46 and belt 32 is that the minimum bottom margin is not limited to the distance from the upstream pinch roller 42 to the print zone 34 as in the conventional printing apparatus of FIG. 1. Referring to FIG. 3, the minimum bottom margin for the printing apparatus 30 is the distance $d_m$, which extends from an area 86 at or adjacent to the distal edge 56 of the shim 46 to an edge 58 of the print zone 34. In some instances the area 86 is adjacent to the edge 56 in a direction away from the print zone 34 to account for a media sheet edge which is not parallel with the shim edge 56. The edge 58 of the print zone 34 is defined by the most peripheral inkjet nozzles 15*a* closest to the shim 46. Thus, the minimum bottom margin approximates the distance from inkjet nozzles located closest to the edge 58 of the print zone in the direction of the guide shim 46 to an edge 56 of the guide shim located closest to the print zone 34. As can be seen from FIG. 3, the distance $d_m$ is substantially less than the distance $d_p$, from the pinch roller 42 line of contact 59 to the print zone edge 58. Thus, a smaller minimum bottom margin is achievable by the apparatus 30. This is true for apparatus embodiments which move a single sheet or cut sheet through the print zone 34, and is distinct from a continuous feed of attached media sheets which are not separated into individual sheets until after passing through the print zone.

An advantage of the belt 32 is that it is a moving support which maintains intimate contact with the media sheet during printing. The intimacy and stability of the contact with the media sheet results in improved media advance accuracy through the print zone 34.

Figure 4:
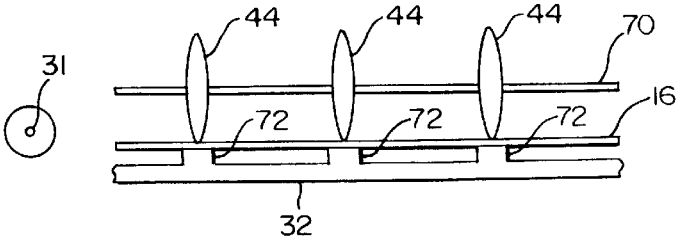
FIG. 4 is a cross sectional view of a portion of the belt and star wheel pinch rollers of FIG. 2 according to one embodiment of this invention.

Referring to FIG. 4 the downstream pinch roller 44 includes multiple star wheel rollers. The star wheel rollers 44 may be idle with individual mountings, or may be driven and have a common axle 70. In one embodiment the belt 32 is ribbed with the ribbing extending along the direction of motion 31. The media sheet 16 moves under the star wheel rollers 44 along the ribs 72 of belt 32.

Alternative Embodiments

Figure 5:
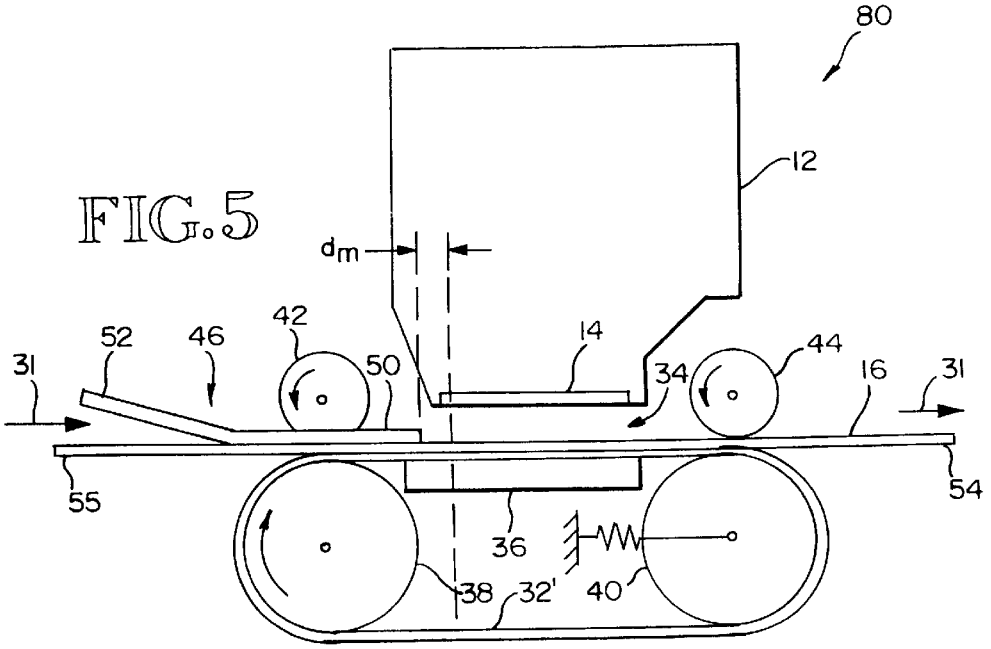
FIG. 5 is a diagram of a portion of an inkjet printing apparatus according to another embodiment of this invention.

Referring to FIG. 5, an inkjet printing apparatus 80 according to an alternative embodiment is shown. Like parts of apparatus 80 similar to corresponding parts of apparatus 30 have like numbers. The printing apparatus 80 includes a belt 32' which has a grit coating rather than ribs. Preferably, the belt 32' is stiff enough to prevent stretching over time. However, the spring-loading of idler roller 40 serves to maintain a desired belt tension even in the presence of some stretching. The belt 32' is reinforced with Kevlar in some embodiments to resist stretching. The grit coating of belt 32' includes particles dispersed within or on top of the coating. In an exemplary embodiment, a polyurethane coating is used with a grit of aluminum oxide particles having an average particle size of 0.0005 inches to 0.005 inches. One of ordinary skill in the art will appreciate that other coating and particle sizes also may be used. Further, the inventive concepts also apply for a smooth belt.

The inkjet printing apparatus 80 includes an inkjet pen 12 having a printhead 14. The printhead 14 includes a plurality of inkjet nozzles 15 (see FIG. 3) which eject ink onto a media sheet 16 during printing. The media sheet 16 is moved along a media path in a direction 31 by one or more rollers. Over a portion of the media path, the media sheet 16 is carried by a support 32. In a preferred embodiment the support is an endless belt loop 32'. A print zone 34 occurs between the printhead 14 and the belt 32' in a region adjacent to the nozzles 15. The print zone 34 is the area where ink is ejected onto the media sheet 16. Within the print zone 34, a platen 36 maintains the belt 32' in a fixed orientation, (e.g., so as to maintain a desired pen to media sheet spacing). As a result, the media sheet 16 is positioned at a known flat orientation within the print zone and ink is accurately applied to the media sheet 16.

The belt 32' runs along a drive roller 38 and an idler roller 40. The drive roller 38 is rotated by a drive motor causing the belt 32' to move along the rollers 38, 40. The idler roller 40 preferably is spring-loaded to maintain the belt at a desired tension.

The printing apparatus 80 also includes an upstream pinch roller 42, a downstream pinch roller 44, and a guide shim 46. The upstream pinch roller 42 presses the media sheet 16 to an outer surface 47 of the belt 32' in an area between the upstream pinch roller 42 and the drive roller 38. The downstream pinch roller 44 presses the media sheet 16 to an outer surface 47 of the belt 32' in an area between the downstream pinch roller 44 and the idler roller 40. The guide shim 46 includes a first portion 50 which extends from an area at or upstream of the pinch roller 42 toward the print zone 34. Another portion 52 of the guide shim 46 extends from a distal position upstream from the upstream roller 42 toward the roller 42. The portion 50 has a flat orientation relative to the media path through the print zone 34. The portion 52 has a second orientation relative to the media path which differs from the first orientation.

The flat orientation of the shim portion 50 in apparatus 80 differs from the angled orientation of the corresponding shim portion of apparatus 30 (compare FIGS. 2 and 5). Apparatus 30 introduces a reverse bowing of the media sheet 16 to aid in preventing cockle growth and in maintaining media advance accuracy. Apparatus 80 need not introduce such reverse bowing due to the grit coating of the belt 32'. The upstream pinch roller 42 presses the media sheet into the grit coating, which in effect adds a degree of friction and stability to the position of the media sheet 16 relative to the belt 32'. Such stability continues while the trailing edge 55 passes beyond the pinch roller 42 toward the print zone 34.

In operation the drive roller 38 is rotated causing the belt 32' to rotate. A lead edge 54 of the media sheet 16 is guided by the shim 46 the upstream pinch roller 42 and drive roller 38 onto the belt 32'. The belt 32' carries the media sheet 16 as the drive roller 38 moves the belt 32' and the upstream pinch roller 42 presses a passing portion of the media sheet toward the drive roller 38. The belt 32' passes along the platen 36 carrying a portion of the media sheet 16 into the print zone 34. The printhead nozzles 15 eject ink onto the portion of the media sheet 16 within the print zone 34. The printed portion of the media sheet 16 is carried onward from the print zone 34 along belt 32' to the downstream pinch roller 44. The downstream pinch roller 44 presses the media sheet toward the idler roller 40. Preferably the downstream pinch roller 44 has a star wheel configuration which minimizes contact between the pinch roller 44 and the media sheet 16. This is desirable to avoid smudging the ink recently applied to the media sheet 16.

Typically, a media sheet 16 is longer than the distance from the upstream pinch roller 42 to the downstream pinch roller 44 along the media path. As a result, at least one of the upstream pinch roller 42 and downstream pinch roller 44 is in contact with the media sheet 16 while ink is being ejected onto any portion of the media sheet 16. The pinch rollers 42, 44 introduce a measure of stability to the media sheet during printing. In addition the guide shim 46 holds a portion of the media sheet flat keeping the media sheet under the inkjet printhead as the printhead 14 moves over the media sheet 16. This is desirable to prevent cockling of the media sheet where the media sheet bends upward into contact with the inkjet nozzles. Such contact can clog the inkjet nozzles 15 and cause inaccurate dot placement. The guide shim 46 aids in media advance accuracy as the media sheet trailing edge 55 departs contact with the upstream pinch roller 42 and continues on to the print zone 34. Specifically portion 50 of the guide shim 46 extends from the upstream pinch roller 42 toward the print zone 34. The shim together with the star wheel contact of the downstream pinch roller 44 stabilizes the media sheet 16 as the trailing edge 55 moves toward the print zone 34.

An advantage of the stabilizing action of the shim 46 and downstream pinch roller 44 is that the minimum bottom margin is not limited to the distance from the upstream pinch roller 42 to the print zone 34 as in the conventional printing apparatus of FIG. 1. Referring to FIG. 3, the minimum bottom margin for the printing apparatus 80 is the distance $d_m$, which extends from an area 86 at or adjacent to the distal edge 56 of the shim 46 to an edge 58 of the print zone 34. The edge 58 of the print zone 34 is defined by the most peripheral inkjet nozzles 15*a* closest to the shim 46. Thus, the minimum bottom margin approximates the distance from inkjet nozzles located closest to the edge 58 of the print zone in the direction of the guide shim 46 to an edge 56 of the guide shim located closest to the print zone 34. As can be seen from FIG. 3, the distance $d_m$ is substantially less than the distance $d_p$, from the pinch roller 42 line of contact 59 to the print zone edge 58. Thus, a smaller minimum bottom margin is achievable by the apparatus 80. This is true for apparatus embodiments which move a single sheet or cut sheet through the print zone 34, and is distinct from a continuous feed of attached media sheets which are not separated into individual sheets until after passing through the print zone.

An advantage of the belt 32' is that it is a moving support which maintains intimate contact with the media sheet during printing. The intimacy and stability of the contact with the media sheet results in improved media advance accuracy through the print zone 34.

Meritorious and Advantageous Effects

One advantage of the support, pinch roller, guide shim configuration is that media advance accuracy is maintained, and cockle growth is controlled, even while the media sheet trail edge leaves contact with the upstream pinch roller. A beneficial effect is that the minimum bottom margin is reduced. An advantage of the shim is that media advance accuracy is maintained even for pinch rollers which do not spin at identical speeds (e.g., due to manufacturing tolerances).

Although a preferred embodiment of the invention has been illustrated and described, various alternatives, modifications and equivalents may be used. Therefore, the foregoing description should not be taken as limiting the scope of the inventions which are defined by the appended claims.

What is claimed is:

1. An inkjet printing apparatus which moves a media sheet along a media path and marks the media sheet with ink, comprising:

an inkjet pen, including an inkjet printhead having a plurality of inkjet nozzles which eject ink onto a portion of the media sheet located within a print zone, the print zone located adjacent to the plurality of nozzles;

an endless belt support which supports the media sheet at an outer surface of the belt support as the media sheet passes along the media path through the print zone;

a roller located upstream along the media path prior to the print zone, the roller stabilizing the media sheet relative to the outer surface of the belt support; and a guide shim located along the media path, the guide shim having a guide surface extending at least from the roller, beyond the roller into a region between the belt support and the inkjet pen toward an edge of the print zone, the guide shim acting upon a portion of the media sheet between the roller and the print zone to hold the media sheet to the belt support and to keep the media sheet out of contact with the printhead.

2. The inkjet printing apparatus of claim 1, in which the guide shim extends toward and under the printhead.

3. The inkjet printing apparatus of claim 1, having a minimum media sheet page margin which approximates a distance from inkjet nozzles located closest to the edge of the print zone to an edge of the guide shim located closest to the print zone.

4. The inkjet printing apparatus of claim 1, in which the roller is a first roller, and further comprising a second roller located downstream along the media path after the print zone, the second roller stabilizing the media sheet relative to the outer surface of the belt support.

5. The inkjet printing apparatus of claim 3, in which the belt includes ribs extending along a direction of motion of the media sheet, and wherein the second roller comprises a plurality of rollers, each one of the plurality of rollers comprising the second roller being aligned with a rib of the endless belt.

6. The inkjet printing apparatus of claim 1, in which the belt includes ribs extending along a direction of motion of the media sheet.

7. The inkjet printing apparatus of claim 1, in which the belt has a grit coating, wherein the grit coating maintains intimate contact with the media sheet allowing for accurate advancing of the media along the media path through the print zone for all portions of the media sheet.

8. The inkjet printing apparatus of claim 3, in which the belt has a grit coating, wherein the grit coating maintains intimate contact with the media sheet allowing for accurate advancing of the media along the media path through the print zone for all portions of the media sheet.

9. The inkjet printing apparatus of claim 1, wherein the guide surface of the guide shim extends along the media path from an area upstream of the roller toward and passed the roller toward the print zone.

10. The inkjet printing apparatus of claim 1, in which the guide shim introduces a reverse bowing to the media sheet along a media sheet portion between the roller and the print zone.

11. A method for advancing a media sheet along a media path through a print zone of an inkjet printing apparatus, the apparatus including an inkjet pen having a printhead which includes a plurality of inkjet nozzles which eject ink, the print zone located adjacent to the plurality of nozzles, the method comprising the steps of:

receiving the media sheet at a roller which stabilizes the media sheet along the media path relative to a first surface of a moving belt support, the roller located upstream along the media path prior to the print zone;

moving the media sheet under a guide shim, onto the belt support and into the print zone, in which the belt support includes a belt which moves with the media sheet, the guide shim having a guide surface extending at least from the roller, beyond the roller into a region between the belt support and the inkjet pen under the printhead and adjacent to an edge of the print zone, the guide shim acting upon a portion of the media sheet to maintain flatness and advance accuracy of the media sheet as a trailing edge of the media sheet travels beyond the roller toward the print zone; and ejecting ink onto a portion of the media sheet located within the print zone.

12. The method of claim 11, further comprising the step of keeping the media sheet away from the printhead as the media sheet moves through the print zone, the guide shim acting upon a portion of the media sheet between the roller and the print zone to keep the media sheet out of contact with the printhead.

13. The method of claim 11, further comprising the step of discontinuing ejection of ink onto the media sheet while leaving a media sheet margin at least as large as a minimum bottom margin, wherein the minimum bottom margin approximates a distance from inkjet nozzles located closest to the edge of the print zone in the direction of the guide shim to an edge of the guide shim located closest to the print zone.

14. The method of claim 11, in which the guide shim has a guide surface extending at least from the roller, beyond the roller toward the print zone, the guide surface of the guide shim acting upon a portion of the media sheet to introduce a reverse bowing of the media sheet for a portion of the media sheet located between the roller and the print zone.

15. The method of claim 11, wherein the guide surface of the guide shim extends along the media path from an area upstream of the roller toward and passed the roller toward the print zone, and wherein the step of moving the media sheet under the guide shim comprises:

receiving the media sheet at a first portion of the guide shim located upstream of the roller; and moving the media sheet relative to the guide surface toward the print zone; and wherein the sep of receiving the media sheet at the first portion of the guide shim occurs prior to the step of receiving the media sheet at the roller.

16. The method of claim 11, wherein the step of moving the media sheet under a guide shim toward the print zone comprises the step of driving the endless belt to carry the media sheet under the guide shim toward the print zone.

17. The method of claim 11, wherein the step of receiving the media sheet at the roller comprises the step of pressing the media sheet to the belt support.

18. The method of claim 11, in which the roller is a first roller, and further comprising the step of:

receiving the media sheet at a second roller which stabilizes the media sheet along the media path relative to a second surface, the second roller located downstream along the media path after the print zone.

19. The method of claim 18, wherein the step of receiving the media sheet at the second roller comprises the step of pressing the media sheet to the belt support.

* * * * *